United States Patent [19]

Yagihara et al.

[11] Patent Number: 4,914,003

[45] Date of Patent: Apr. 3, 1990

[54] SILVER HALIDE PHOTOGRAPHIC MATERIAL AND PROCESS FOR THE FORMATION OF IMAGE USING SAME

[75] Inventors: Morio Yagihara; Nobuaki Inoue, both of Kanagawa, Japan

[73] Assignee: Fuji Photo Film Co., Ltd., Kanagawa, Japan

[21] Appl. No.: 291,391

[22] Filed: Dec. 27, 1988

Related U.S. Application Data

[63] Continuation of Ser. No. 29,510, Mar. 24, 1987, abandoned.

[30] Foreign Application Priority Data

Mar. 24, 1986 [JP] Japan ..... 61-65130

[51] Int. Cl.[4] ..... G03C 1/06

[52] U.S. Cl. ..... 430/264; 430/446; 430/448; 430/599; 430/600; 430/607; 430/613; 430/614; 430/949

[58] Field of Search ..... 430/264, 599, 600, 607, 430/613, 614, 446, 448, 449, 949

[56] References Cited

U.S. PATENT DOCUMENTS

| | | | |
|---|---|---|---|
| 4,429,036 | 1/1984 | Hirano et al. | 430/949 |
| 4,447,522 | 5/1984 | Hirano et al. | 430/264 |
| 4,581,322 | 4/1986 | Ishiguro et al. | 430/607 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A novel silver halide photographic material is provided comprising at least one light-sensitive silver halide emulsion layer provided on a support and containing at least one hydrazine compound and at least one amine compound of the general formula (I) in said emulsion layer or at least one of other constituting layers, provided that said hydrazine compound and said amine compound can be present in the same or different layers:

(I)

wherein $R^2$ and $R^3$, which can be the same or different, each represents a substituted or unsubstituted alkyl group or $R^2$ and $R^3$ may be linked to each other to form a ring; $R^4$ represents a substituted or unsubstituted alkyl, aryl or heterocyclic group; A represents a divalent linkage group; X represents —$CONR^5$—, —O-$CONR^5$—, —$NR^5CONR^5$—, —$NR^5COO$—, —COO—, —OCO—, —CO—, —$NR^5CO$—, —$SO_2N$-$R^5$—, —$NR^5SO_2$—, —$SO_2$—, —S— or —O— group (in which $R^5$ represents a hydrogen atom or a lower alkyl group having 1 to 5 carbon atoms); and n represents an integer of 0 or 1, with the proviso that the total number of carbon atoms contained in $R^2$, $R^3$, $R^4$ and A is 20 or more. Furthermore, a novel method for forming a superhigh contrast negative image is provided which comprises imagewise exposing a silver halide photographic material comprising at least one silver halide emulsion layer provided on a support and containing at least one hydrazine compound and at least one amine compound of the general formula (I) in said emulsion layer of at least one of other constituting layers to light provided that said hydrazine compound and said amine compound can be present in the same or different layers, and then developing the silver halide photographic material thus exposed with a developing solution having a pH value of 10.5 to 12.0 and containing 0.15 mol/-liter or more of sulfite ions.

14 Claims, No Drawings

SILVER HALIDE PHOTOGRAPHIC MATERIAL AND PROCESS FOR THE FORMATION OF IMAGE USING SAME

This is a continuation of application Ser. No. 029,510 filed Mar. 24, 1987, now abandoned.

FIELD OF THE INVENTION

The present invention relates to a silver halide photographic material. More particularly, the present invention relates to a silver halide photographic material which can form a superhigh contrast negative image particularly useful in a photomechanical process by using a stable processing solution.

BACKGROUND OF THE INVENTION

In a photomechanical process, it is required to obtain a superhigh contrast property (particularly $\gamma$ of 10 or more) in order to improve reproduction of continuous tone image by a dot image process or reproduction of line original. To this end, a combination of a light-sensitive material comprising a silver chloride emulsion or a silver chlorobromide emulsion having a high silver chloride content and a hydroquinone developing solution having an extremely low effective concentration of sulfite ions (generally not more than 0.1 mol/liter) (infectious developing solution) has heretofore been generally used. However, such an infectious developing solution is disadvantageous in that it is extremely unstable due to its low sulfite ion concentration, making it impossible to be stored for more than 3 days.

Examples of improved methods for attaining a superhigh photographic property by using a stable developing solution include a method using specific hydrazine compounds as described in U.S. Pat. No. 4,224,401, etc. In this method, a high concentration of sulfite ion is allowed to be present in the developing solution. This protects the developing solution against aerial oxidation, improving its stability.

Japanese patent application (OPI) No. 106244/81 (the term "OPI" as used herein refers to a "published unexamined Japanese patent application") proposes that an amine compound be added to the developing solution in order to further improve the superhigh contrast image-forming method using the above-described hydrazine compounds so that a negative image having a high gamma value can be obtained by using a developing solution having a lower pH value.

However, this method is disadvantageous in that the use of a relatively high amount of amines causes generation of odor peculiar to amines and makes it difficult to keep the concentration of amines constant. This method is also disadvantageous in that a long developing time is required to obtain the desired results due to its insufficient developing rate.

In order to solve these problems, it is proposed that amine compounds as described in Japanese patent application (OPI) No. 140340/85 be incorporated in the light-sensitive material.

However, it was found that the specific amine compounds described in the above-described patent are disadvantageous in that they effuse into the developing solution and therefore exert an adverse effect on other photographic light-sensitive materials and that they easily cause a problem called "black pepper" in the art when the system using the hydrazine derivative is employed.

The term "black pepper" as used herein means a black spot produced on a nonimage portion (e.g., portion between dots). This defect usually occurs when the concentration of sulfite ions used as preservatives is decreased or the pH value of the developing solution is raised due to fatigue of the developing solution.

SUMMARY OF THE INVENTION

It is therefore an object of the present invention to provide a silver halide photographic material which provides a high sensitivity and superhigh contrast photographic property by using a stable developing solution, provides a high developing rate, causes little black pepper, and exerts no adverse effect on other photographic light-sensitive materials even when its component effuses into the developing solution.

It is another object of the present invention to provide a method for forming a superhigh contrast negative image by using such a silver halide photographic material.

These objects of the present invention will become more apparent from the following detailed description and examples.

These objects of the present invention are accomplished with a silver halide photographic material comprising at least one silver halide emulsion layer provided on a support and containing at least one hydrazine compound and at least one amine compound of the general formula (I) in the emulsion layer or at least one of other constituting layers. These objects of the present invention are also accomplished by a method for forming a superhigh contrast negative image, which comprises imagewise exposing such a silver halide photographic material to light, and then developing the silver halide photographic material thus exposed with a developing solution containing 0.15 mol/liter or more of sulfite ions and having a pH value of 10.5 to 12.0.

The general formula (I) is as follows:

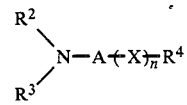

(I)

wherein $R^2$ and $R^3$, which may be the same or different, each represents a substituted or unsubstituted alkyl group or $R^2$ and $R^3$ may be linked to each other to form a ring; $R^4$ represents a substituted or unsubstituted alkyl, aryl or heterocyclic group; A represents a divalent linkage group, preferably an alkylene group which may be substituted; X represents —$CONR^5$—, —O-$CONR^5$—, —$NR^5CONR^5$—, —$NR^5COO$—, —COO—, —OCO—, —CO—, —$NR^5CO$—, —$SO_2N$-$R^5$—, —$NR^5SO_2$—, —$SO_2$—, —S— or —O— group (in which $R^5$ represents a hydrogen atom or a lower alkyl group); and n represents an integer of 0 or 1, with the proviso that the total number of carbon atoms contained in $R^2$, $R^3$, $R^4$ and A is 20 or more.

It is known as described above that the use of a hydrazine compound can provide a superhigh contrast photographic property of $\gamma$ of 10 or more and a high sensitivity even if the photographic material is developed with a stable developing solution containing 0.15 mol/liter or more of sulfite ions. In the present invention, it is possible to obtain a superhigh contrast and a high sensitivity in a relatively short developing time even when a developing solution with a relatively low pH value (i.e., a pH value of 10.5 to 12.0) is used by incorporating an amine compound in the photographic light-sensitive material in combination with the hydrazine compound.

Furthermore, the present invention is advantageous in that odor due to the use of such an amine compound does not occur and there is no need for complicated control of the composition of the developing solution.

In particular, the present invention is very useful because the incorporation of amines in the photographic light-sensitive material can provide a sufficient sensitizing effect and a superhigh contrast property and give a remarkable improvement in the black pepper problem in a system which must be subjected to weakening of the effects of sensitizing and providing a superhigh contrast (e.g., a system in which a sufficient amount of a hydrazine compound cannot be added in order to inhibit changes in photographic properties due to aging during storage or abrasion fog or a system in which an emulsion which has not been subjected to gold sensitization but only to sulfur sensitization is used in order to inhibit spot fog or abrasion fog).

DETAILED DESCRIPTION OF THE INVENTION

The amine compound of the general formula (I) to be used in the present invention will be further described hereinafter.

The general formula (I) is as follows:

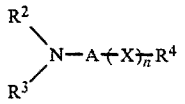

(I)

wherein $R^2$ and $R^3$, which can be the same or different, each represents a substituted or unsubstituted alkyl group having 1 to 30 carbon atoms, which may be a straight chain, branched or cyclic group.

$R^2$ and $R^3$ may also be linked to form a ring. In this case, $R^2$ and $R^3$ may be cyclized in such an arrangement as to form a saturated hetero ring containing one or more hetero atoms such as an oxygen atom, a sulfur atom and a nitrogen atom. Examples of such a group represented by $R^2$ or $R^3$ include a methyl group, an ethyl group, an isopropyl group, an n-butyl group, an n-octyl group, a t-octyl group, a cyclohexyl group, a pyrrolidyl group, and a morpholino group. Examples of the substituents for $R^2$ and $R^3$ include an aryl group (preferably having 6 to 20 carbon atoms), an alkoxy group (preferably having 1 to 20 carbon atoms), a sulfo group, a sulfonamide group (preferably an alkylsulfonamide group having 1 to 20 carbon atoms or an arylsulfonamide group having 6 to 20 carbon atoms), a carbonamide group (preferably an alkylcarbonamide group having 2 to 20 carbon atoms or an arylcarbonamide group having 7 to 20 carbon atoms), and a ureido group (preferably an alkylureido group having 1 to 20 carbon atoms or an arylureido group having 6 to 20 carbon atoms). Examples of the group represented by $R^4$ include substituted or unsubstituted alkyl groups having 1 to 30 carbon atoms such as a methyl group, an ethyl group, an n-butyl group, an n-octyl group, an n-dodecyl group, an n-hexadecyl group, a t-butyl group, and a cyclohexyl group, substituted or unsubstituted aryl groups having 6 to 30 carbon atoms such as a phenyl group and a naphthyl group, and substituted or unsubstituted heterocyclic groups such as 5-, 6- and 7-membered heterocyclic compounds containing one or more nitrogen, oxygen or sulfur atoms. These heterocyclic compounds may form condensed rings in proper positions. Specific examples of such heterocyclic compounds include a pyridine ring, a pyrimidine ring, an imidazole ring, a quinoline ring, an isoquinoline ring, a benzimidazole ring, a thiazole ring, and a benzothiazole ring. Examples of the substituents for $R^4$ include halogen atoms such as fluorine, chlorine and bromine, alkyl groups (preferably having 1 to 20 carbon atoms), aryl groups (preferably having 6 to 20 carbon atoms), alkoxy groups (preferably having 1 to 20 carbon atoms), aryloxy groups (preferably having 6 to 20 carbon atoms), alkylthio groups (preferably having 1 to 20 carbon atoms), arylthio groups (preferably having 6 to 20 carbon atoms), acyl groups (preferably having 2 to 20 carbon atoms), acylamino groups (preferably an alkanoylamino group having 1 to 20 carbon atoms or a benzoylamino group having 6 to 20 carbon atoms), nitro groups, cyano groups, oxycarbonyl groups (preferably an alkoxycarbonyl group having 1 to 20 carbon atoms or an aryloxycarbonyl group having 6 to 20 carbon atoms), hydroxy groups, carboxy groups, sulfo groups, ureido groups (preferably an alkylureido group having 1 to 20 carbon atoms or an arylureido group having 6 to 20 carbon atoms), sulfonamide groups (preferably an alkylsulfonamide group having 1 to 20 carbon atoms or an arylsulfonamide group having 6 to 20 carbon atoms), sulfamoyl groups (preferably an alkylsulfamoyl group having 1 to 20 carbon atoms or an arylsulfamoyl group having 6 to 20 carbon atoms), carbamoyl groups (preferably an alkylcarbamoyl group having 1 to 20 carbon atoms or an arylcarbamoyl group having 6 to 20 carbon atoms), acyloxy groups (preferably having 1 to 20 carbon atoms), amino groups (unsubstituted amino groups or secondary or tertiary amino groups preferably substituted by alkyl groups having 1 to 20 carbon atoms or aryl groups having 6 to 20 carbon atoms), carbonic ester groups (preferably alkyl carbonic ester groups having 1 to 20 carbon atoms or aryl carbonic ester groups having 6 to 20 carbon atoms), sulfone groups (preferably an alkylsulfone group having 1 to 20 carbon atoms or an arylsulfone group having 6 to 20 carbon atoms), and sulfinyl groups (preferably an alkylsulfinyl group having 1 to 20 carbon atoms or an arylsulfinyl group having 6 to 20 carbon atoms). The group represented by $R^4$ may be substituted by two or more of such substituents which may be the same or different.

In the general formula (I), A represents a divalent linkage group such as an alkylene group having 1 to 10 carbon atoms, an arylene group having 6 to 10 carbon atoms, an alkenylene group having 1 to 10 carbon atoms, an aralkylene group having 7 to 10 carbon atoms, or a combination thereof, which may be substituted. Examples of the substituents for A include an aryl group, an alkoxy group, a hydroxy group, and a halogen atom. In the general formula (I), A preferably represents an alkylene group which may be substituted. Examples of such an alkylene group include a methylene group, a dimethylene group, a trimethylene group, a tetramethylene group and a methylpropylene group.

In the general formula (I), X represents $-CONR^5-$, $-OCONR^5-$, $-NR^5CONR^5-$, $-NR^5COO-$, $-COO-$, $-OCO-$, $-CO-$, $-NR^5CO-$, $-SO_2NR^5-$, $-NR^5SO_2-$, $-SO_2-$, $-S-$ and $-O-$ wherein $R^5$ represents a hydrogen atom, or a lower alkyl group having 1 to 5 carbon atoms. In the general formula (I), n represents an integer of 0 or 1. The total number of carbon atoms contained in $R^2$, $R^3$, $R^4$ and A in the general formula (I) is 20 or more, preferably from 20 to 60.

If the total number of carbon atoms is less than 20, the effect of inhibiting black pepper is not sufficient.

Specific examples of amine compounds represented by the general formula (I) will be shown hereinafter, but the present invention should not be construed as being limited thereto.

(I-1)

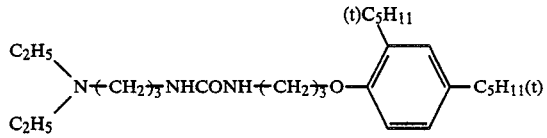

(I-2)

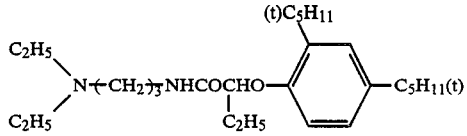

(I-3)

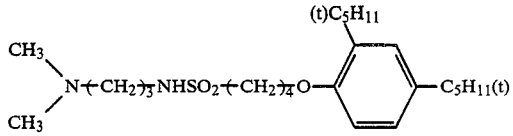

(I-4)

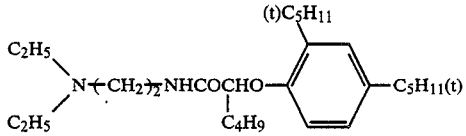

(I-5)

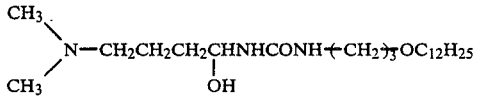

(I-6)

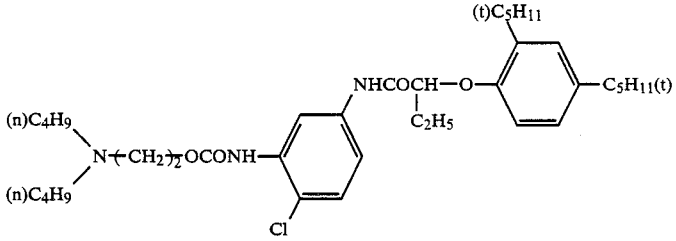

(I-7)

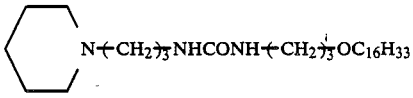

(I-8)

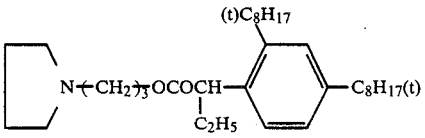

(I-9)

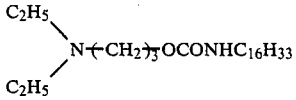

(I-10)

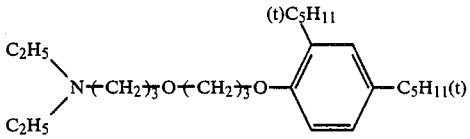

-continued

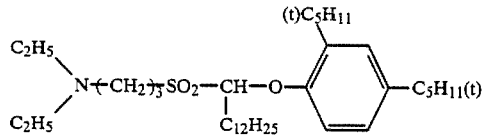

(I-11)

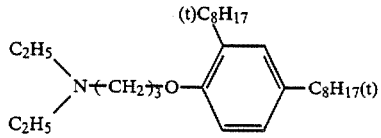

(I-12)

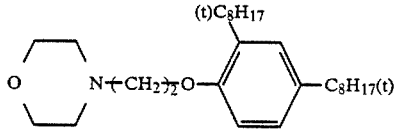

(I-13)

Specific examples of synthesis of amine compounds represented by the general formula (I) will be described hereinafter.

SYNTHESIS EXAMPLE 1

Exemplary Compound (I-1)

78.3 g (0.5 mol) of phenyl chloroformate was dissolved in 250 ml of acetonitrile. A mixed solution of 137 g (0.45 mol) of 3-(2,4-diamylphenoxy)propylamine, 69.5 ml of triethylamine and 250 ml of acetonitrile was added dropwise to the solution thus formed in about 3 hours with stirring while the latter was cooled with ice at a temperature of 0° C. After the dropwise addition was finished, the reaction temperature was raised to 25° C. 2 l of ice water was added to the admixture. The admixture was then extracted with chloroform. The chloroform was removed under reduced pressure. Methanol was added to the residual oily matter to obtain 150 g of 3-(2,4-diamylphenoxy)-1-phenoxycarbonylaminopropane.

10.2 g (0.025 mol) of the urethane compound and 3.3 g (0.025 mol) of 3-diethylaminopropylamine were dissolved in 10 ml of dimethylacetamide. The admixture was then allowed to undergo reaction with stirring under heating at a temperature of 60° C. for 4 hours. The reaction temperature was lowered back to 25° C. 100 ml of water was added to the reaction system. The solution was then extracted three times with 100 ml of n-hexane. The n-hexane was removed under reduced pressure to obtain exemplary Compound (I-1). Yield: 9.8 g (88%), oily matter.

SYNTHESIS EXAMPLE 2

Exemplary Compound (I-2)

50 ml (0.32 mol) of diethylaminopropylamine was dissolved in 100 ml of acetonitrile. 101.7 g (0.3 mol) of chloride α-(2,4-diamylphenoxy)butylate was added to the solution thus formed with stirring under cooling (at 5° C.). The admixture was allowed to undergo reaction at room temperature for about 1 hour. 300 ml of water was poured into the reaction system. 5.3 ml of concentrated hydrochloric acid and 100 ml of ethanol were added to the reaction system. The admixture was then extracted with 300 ml of n-hexane three times. An alkali water comprising 16.2 g of sodium hydroxide dissolved in 160 ml of water was then added to the resulting aqueous phase. The admixture was extracted with 300 ml of n-hexane. The hexane phase was washed with 200 ml of water three times. 6.0 ml of activated carbon was added to the hexane phase. The admixture was heated under reflux, and then allowed to cool to room temperature. The n-hexane was removed under reduced pressure to obtain exemplary Compound (I-2). Yield: 112.2 g (86.4%), m.p.: 41° to 42° C.

The content of the compound of the present invention of the general formula (I) is preferably $1\times10^{-5}$ to $1\times10^{-1}$ mol, more preferably $1\times10^{-4}$ to $5\times10^{-2}$ mol, per mol of total silver halide.

In the present invention, when the compound of the general formula (I) is incorporated in the photographic light-sensitive material, it is preferably contained in the silver halide emulsion layer. However, it may be contained in other light-insensitive hydrophilic colloid layers such as a protective layer, an intermediate layer, a filter layer, and an antihalation layer. In particular, if the compound to be used is water-soluble, it may be added to the hydrophilic colloid layer in the form of an aqueous solution. If the compound is sparingly water-soluble, it may be added to the hydrophilic colloid solution in the form of a solution in an organic solvent miscible with water such as alcohols, esters and ketones. If the compound is incorporated in the silver halide emulsion layer, the addition may be conducted at any time between the beginning of chemical ripening and before coating, preferably between the completion of chemical ripening and before coating. In particular, the compound is preferably added to a coating solution which has been prepared for coating.

The compound of the general formula (I) may be incorporated in the same layer as or in a different layer from the hydrazine compound.

As the present hydrazine compound there is preferably used a compound of the general formula (II):

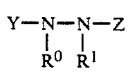

(II)

wherein Y represents an aliphatic, aromatic or heterocyclic group; Z represents a formyl group, an acyl group, an alkyl- or arylsulfonyl group, an alkyl- or arylsulfinyl group, a carbamoyl group, a sulfamoyl group, an alkoxy- or aryloxycarbonyl group, a sulfinamoyl group, an alkoxysulfonyl group, a thioacyl group, a thiocarbamoyl group, or a heterocyclic group; and $R^0$ and $R^1$ each represents a hydrogen atom or one of $R^0$ and $R^1$ represents a hydrogen atom and the other represents a substituted or unsubstituted alkylsulfonyl group, a substituted or unsubstituted arylsulfonyl group, a substituted or unsubstituted acyl group, with the proviso that Z, $R^1$ and the nitrogen atom to which Z and $R^1$ are bonded may form a partial structure of hydrazine

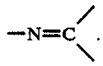

The general formula (II) will be further described hereinafter.

In the general formula (II), the aliphatic group represented by Y is preferably an aliphatic group having 1 to 30 carbon atoms, particularly a straight chain, branched or cyclic alkyl group having 1 to 20 carbon atoms. Such a branched alkyl group may be cyclized so that it forms a saturated heterocyclic group containing one or more hetero atoms. Such an alkyl group may also contain a substituent such as an aryl group, an alkoxy group, a sulfoxy group, a sulfonamide group, and a carbonamide group.

Examples of such an aliphatic group include a t-butyl group, an n-octyl group, a t-octyl group, a cyclohexyl group, a pyrrolidinyl group, an imidazolyl group, a tetrahydrofuryl group and a morpholino group.

In the general formula (II), the aromatic group or heterocyclic group represented by Y is a monocyclic or bicyclic aryl group or unsaturated heterocyclic group. Such an unsaturated heterocyclic group may be condensed with a monocyclic or bicyclic aryl group to form a heteroaryl group.

Examples of such an aromatic or heterocyclic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Particularly preferred among these rings are those containing benzene rings.

An aryl group is particularly preferred as the group represented by Y.

The aryl group or unsaturated heterocyclic group represented by Y may contain substituents. Typical examples of such substituents include straight chain, branched or cyclic alkyl groups (preferably having 1 to 20 carbon atoms), aralkyl groups (preferably monocyclic or bicyclic aralkyl groups having 1 to 3 carbon atoms in the alkyl portion), alkoxy groups (preferably having 1 to 20 carbon atoms), substituted amino groups (preferably substituted by an alkyl group having 1 to 20 carbon atoms), acylamino groups (preferably having 2 to 30 carbon atoms), sulfonamide groups (preferably having 1 to 30 carbon atoms), and ureido groups (preferably having 1 to 30 carbon atoms).

Y in the general formula (II) may comprise a ballast group which is commonly used in an immobile photographic additive such as a coupler. A ballast group is a relatively photographically inactive group containing 8 or more carbon atoms. Such a ballast group can be selected from the group consisting of an alkyl group, an alkoxy group, a phenyl group, an alkylphenyl group, a phenoxy group, and an alkylphenoxy group.

Y in the general formula (II) may comprise a group which improves adsorption to the surface of silver halide grains. Examples of such an adsorption group include thiourea groups, heterocyclic thioamide groups, mercapto heterocyclic groups, and triazole groups as described in U.S. Pat. Nos. 4,385,108 and 4,459,347, Japanese patent application (OPI) Nos. 195233/84, 200231/84, 201045/84, 201046/84, 201047/84, 201048/84, 201049/84, 179734/85, 170733/86, and 948/87.

Specific examples of the group represented by Z include formyl groups, acyl groups such as an acetyl group, a propionyl group, a trifluoroacetyl group, a chloroacetyl group, a benzoyl group, a 4-chlorobenzoyl group, a pyruvoyl group, a methoxalyl group and a methyloxamoyl group, alkylsulfonyl groups such as a methanesulfonyl group and a 2-chloroethanesulfonyl group, arylsulfonyl groups such as a benzenesulfonyl group, alkylsulfinyl groups such as a methanesulfinyl group, arylsulfinyl groups such as a benzenesulfinyl group, carbamoyl groups such as a methylcarbamoyl group and a phenylcarbamoyl group, sulfamoyl groups such as a dimethylsulfamoyl group, alkoxycarbonyl groups such as a methoxycarbonyl group and a methoxyethoxycarbonyl group, aryloxycarbonyl groups such as a phenoxycarbonyl group, sulfinamoyl groups such as a methylsulfinamoyl group, alkoxysulfonyl groups such as a methoxysulfonyl group and an ethoxysulfonyl group, thioacyl groups such as a methylthiocarbonyl group, thiocarbamoyl groups such as a methylthiocarbamoyl group, and heterocyclic groups such as a pyridine group.

Particularly preferred among these groups are formyl groups and acyl groups.

In the general formula (II), Z together with $R^1$ and the nitrogen atom to which Z and $R^1$ are bonded may form a partial structure of hydrazone

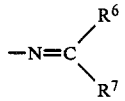

wherein $R^6$ represents an alkyl, aryl or heterocyclic group; and $R^7$ represents a hydrogen atom, an alkyl group, an aryl group, or a heterocyclic group.

Examples of the groups represented by $R^0$ or $R^1$ include a hydrogen atom, alkylsulfonyl groups or arylsulfonyl groups containing 20 or less carbon atoms (preferably phenylsulfonyl groups or phenylsulfonyl groups which are substituted such that the sum of Hammett's substituent constants is −0.5 or more), acyl groups containing 20 or less carbon atoms (preferably benzoyl groups or benzoyl groups which are substituted such that the sum of Hammett's substituent constants is −0.5 or more), and straight chain, branched or cyclic unsubstituted or substituted aliphatic acyl groups.

The substituents of the groups represented by $R^0$ and $R^1$ include halogen atoms, ether groups, sulfonamide groups, carbonamide groups, hydroxyl groups, carboxy groups, and sulfonic acid groups.

$R^0$ and $R^1$ each are most preferably hydrogen atoms.

In the present invention, when the compound of the general formula (II) is incorporated in the photographic light-sensitive material, it is preferably contained in the silver halide emulsion layer. However, it may be contained in other light-insensitive hydrophilic colloid layers such as a protective layer, an intermediate layer, a filter layer, and an antihalation layer. In particular, if the compound to be used is water-soluble, it may be added to the hydrophilic colloid solution in the form of an aqueous solution. If the compound is sparingly water-soluble, it may be added to the hydrophilic colloid solution in the form of a solution in an organic solvent miscible with water such as alcohols, esters, and ketones. If the compound is added to the silver halide emulsion layer, the addition may be conducted at any time between the beginning of chemical ripening and before coating, preferably between the completion of chemical ripening and before coating. In particular, the compound is preferably added to a coating solution which has been prepared for coating.

The optimum content of the compound of the general formula (II) is preferably selected depending on the grain diameter of the silver halide emulsion, halogen composition, process and degree of chemical sensitization, relationship between the layer in which the compound is to be contained and the silver halide emulsion layer, and type of fog inhibitor. The test method for the selection of the optimum value is well known to those skilled in the art. The optimum value is preferably $1\times10^{-6}$ to $1\times10^{-1}$ mol, particularly $1\times10^{-5}$ to $4\times10^{-2}$ mol, per mol of total silver halide.

Specific examples of the compound of the general formula (II) will be shown hereinafter, but the present invention should not be construed as being limited thereto.

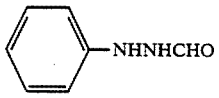

(II-1)

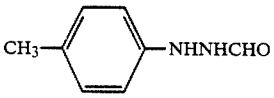

(II-2)

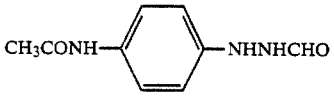

(II-3)

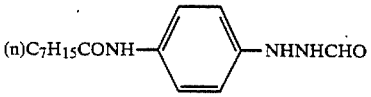

(II-4)

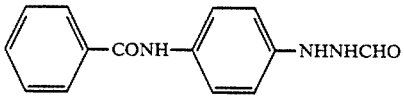

(II-5)

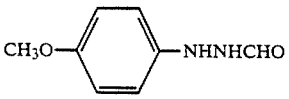

(II-6)

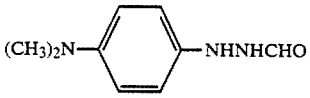

(II-7)

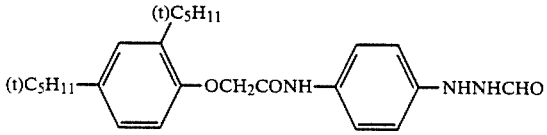

(II-8)

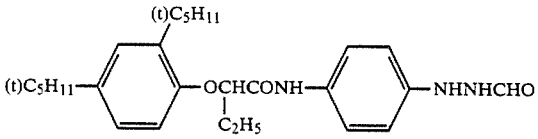

(II-9)

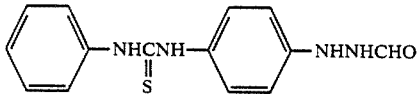

(II-10)

-continued
(II-11)
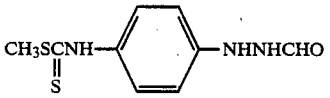
(II-12)
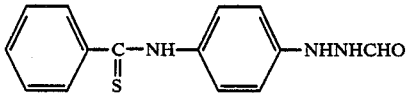
(II-13)
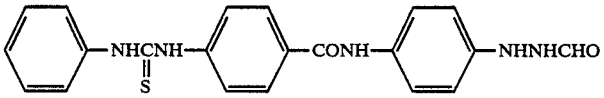
(II-14)
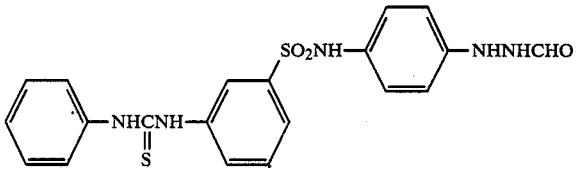
(II-15)
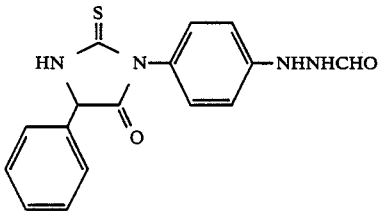
(II-16)
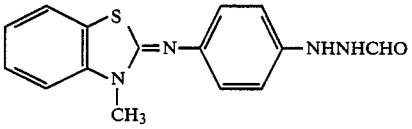
(II-17)
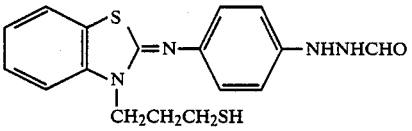
(II-18)
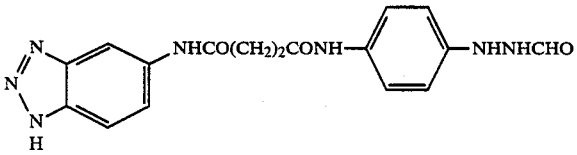
(II-19)
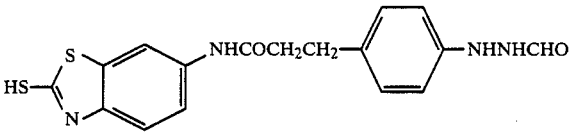
(II-20)
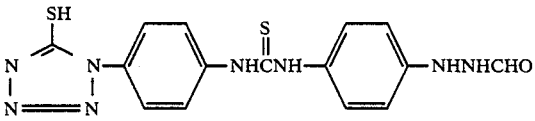

-continued
(II-21)
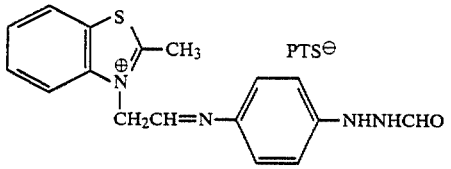
(II-22)
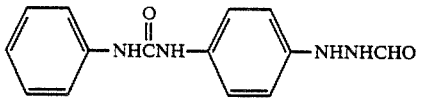
(II-23)
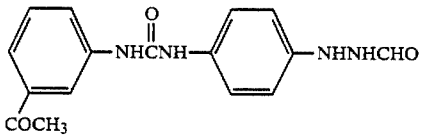
(II-24)
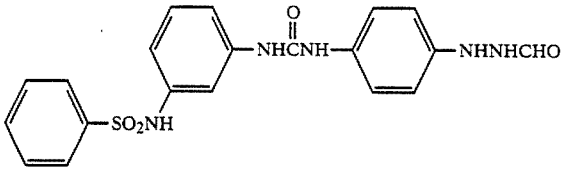
(II-25)
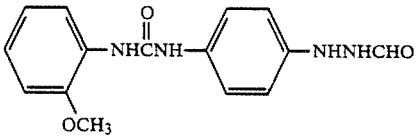
(II-26)
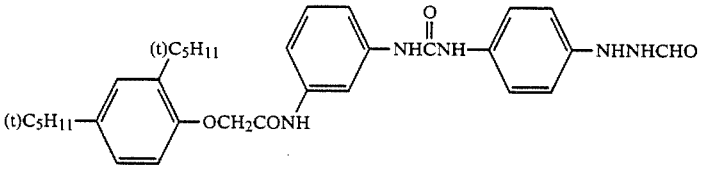
(II-27)
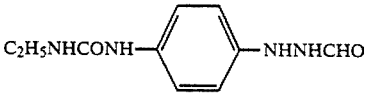
(II-28)
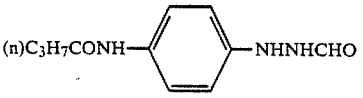
(II-29)
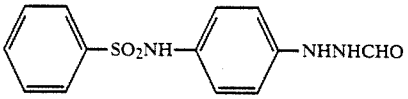
(II-30)
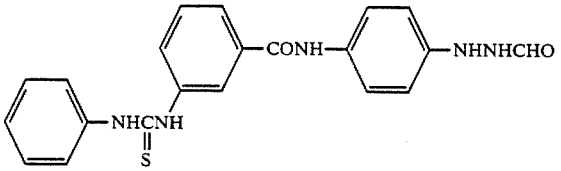

-continued
(II-31)
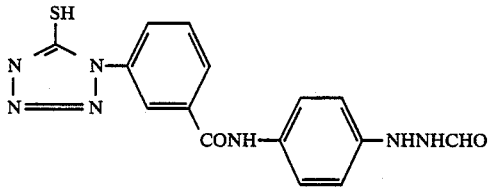
(II-32)
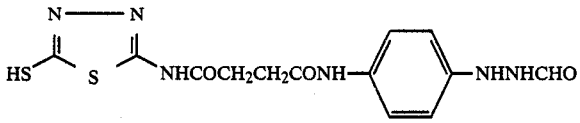
(II-33)
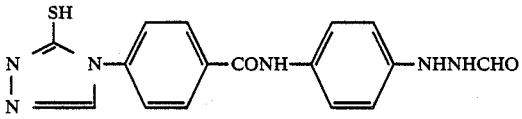
(II-34)
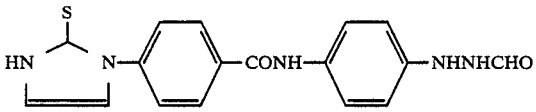
(II-35)
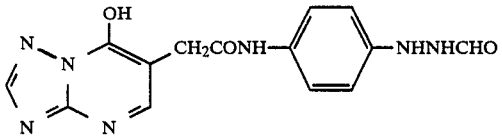
(II-36)
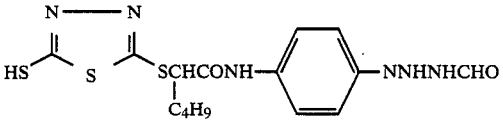
(II-37)
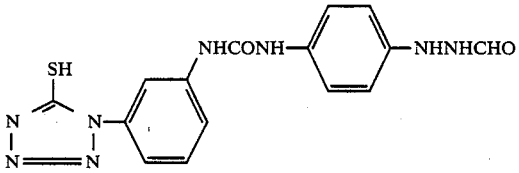
(II-38)
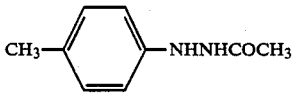
(II-39)
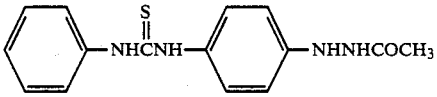
(II-40)
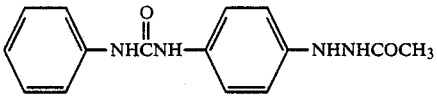
(II-41)
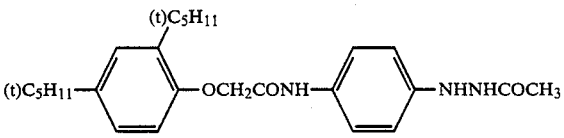

-continued
(II-42)
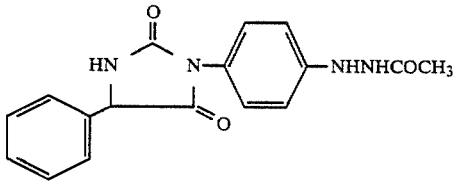
(II-43)
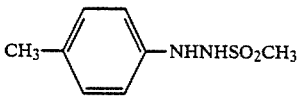
(II-44)
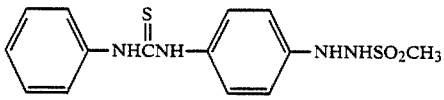
(II-45)
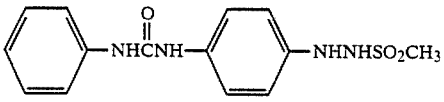
(II-46)
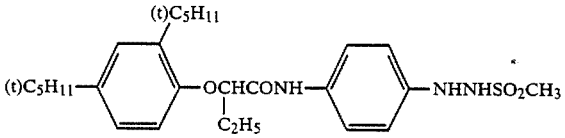
(II-47)
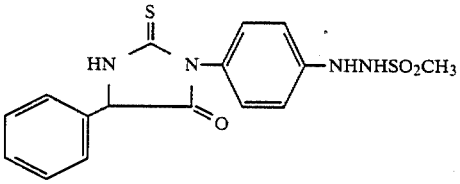
(II-48)
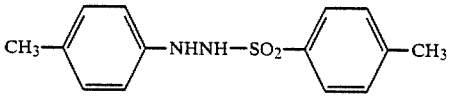
(II-49)
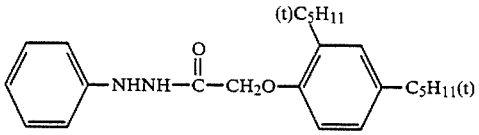
(II-50)
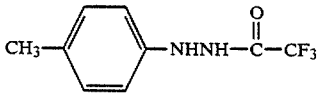
(II-51)
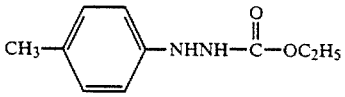
(II-52)
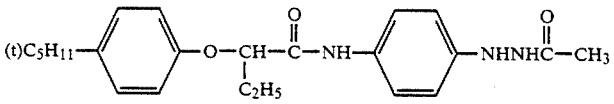
(II-53)
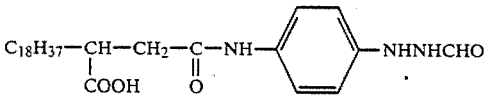

-continued
(II-54)
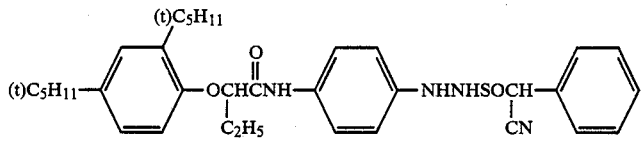
(II-55)
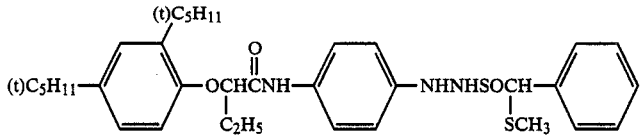
(II-56)
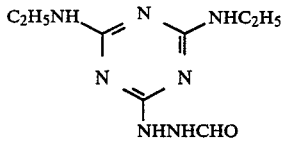
(II-57)
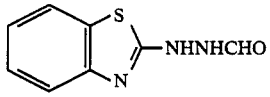
(II-58)
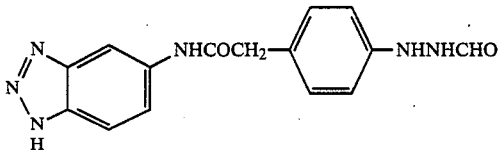
(II-59)
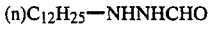
(II-60)
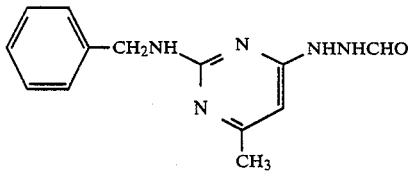
(II-61)
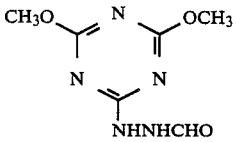
(II-62)
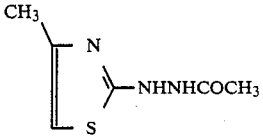
(II-63)
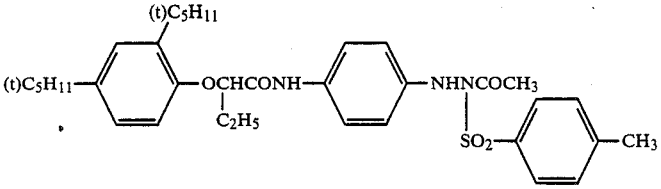

-continued (II-64)

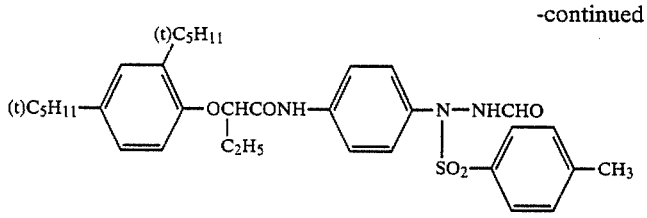

(II-65)

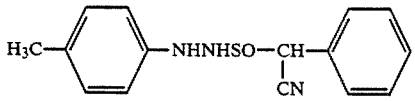

(II-66)

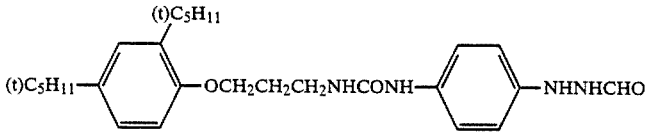

(II-67)

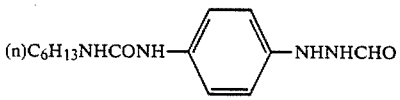

(II-68)

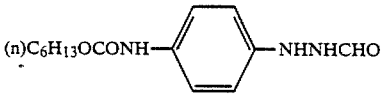

(II-69)

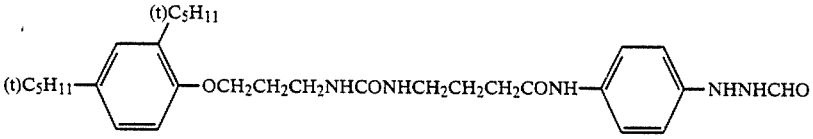

wherein PTS⊖ represents

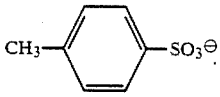

Methods of synthesizing the compounds of the general formula (II) to be used in the present invention are described in Japanese patent application (OPI) Nos. 20921/78, 20922/78, 66732/78 and 20318/78, and U.S. Pat. Nos. 4,459,347 and 4,478,928.

The silver halide emulsion to be used in the present invention may have any composition such as silver chloride, silver chlorobromide, silver iodobromide, and silver iodochlorobromide.

The average grain size of the silver halide to be used in the present invention is preferably in the range of that of finely divided grains (e.g., 0.7 μm or less), particularly 0.5 μm or less. The distribution of grain size is not essentially limited, but is preferably monodispersion. The term "monodispersion" as used herein means a dispersion in which at least 95% by weight or number of the grains consists of grains having sizes within ±40% of the average grain size.

The silver halide grains contained in the photographic emulsion may be in the form of a regular crystal form such as a cube and an octahedron, an irregular crystal form such as a sphere and a tabular form or a composite thereof.

The silver halide grains used in the present invention may differ in phase between the inside thereof and the surface portion thereof or may be homogeneous. Alternatively, the silver halide grains may be a mixture of two or more silver halide emulsions which have been separately prepared.

The layer containing the silver halide emulsion may be in the form of a single layer or multilayer.

The silver halide emulsion to be used in the present invention may have a cadmium salt, sulfite salt, lead salt, thallium salt, rhodium salt or complex salt thereof, or iridium salt or complex salt thereof present therewith in the process of formation or physical ripening of the silver halide grains.

In the present invention, a silver halide emulsion particularly suitable as a light-sensitive material for use in photographing of line drawings or dot making preferably comprises a silver halide having a silver bromide content of 70 mol % or more, particularly 90 mol % or more, prepared with $10^{-8}$ to $10^{-5}$ mol of iridium salt or its complex salt per 1 mol of silver present therein. Furthermore, there is preferably used a silver haloiodide having a silver iodide content of 10 mol % or less, particularly 0.1 to 5 mol %, and a silver iodide content of the grain surface more than the grain average silver iodide content. The use of an emulsion containing such a silver haloiodide can provide photographic properties with a higher sensitivity and a high gamma.

The above-described amount of iridium salt is preferably added before physical ripening, particularly during formation of silver halide grains in the process of preparing the silver halide emulsion.

The iridium salt to be used in the present invention is preferably a water-soluble iridium salt or iridium complex salt such as iridium trichloride, iridium tetrachloride, potassium hexachloroiridiumate (III), potassium hexachloroiridiumate (IV), and ammonium hexachloroiridiumate (III).

The present invention can be applied to a silver halide photographic material whose sensitivity is remarkably low so that it can be easily handled under a fluorescent lamp free of ultraviolet light. A particularly suitable silver halide emulsion preferably comprises a composition prepared with $1\times10^{-6}$ to $1\times10^{-3}$ mol per mol of silver of a rhodium salt or its complex salt present therein and comprising at least 50 mol %, more preferably at least 70 mol %, particularly at least 95 mol %, of silver chloride.

Typical examples of such a water-soluble rhodium salt to be used in the present invention include rhodium chloride, rhodium trichloride and rhodium ammonium chloride. Furthermore, complex salts of these salts can be used. The time at which the above-described rhodium salt is added must be before physical ripening during the preparation of the emulsion, particularly during the formation of grains.

As a binding agent or protective colloid for the present photographic emulsion, there is advantageously used gelatin (lime-treated gelatin, acid-treated gelatin or the like). However, other hydrophilic colloids can be used. Examples of such hydrophilic colloids include proteins such as gelatin derivatives, graft polymers of gelatin with other high molecular compounds, albumin and casein, sugar derivatives such as cellulose derivatives (e.g., hydroxyethyl cellulose, carboxymethyl cellulose, and cellulose ester sulfate), sodium alginate and starch derivatives, and homopolymers or copolymers such as polyvinyl alcohols, polyvinyl alcohol partial acetals, poly-N-vinyl pyrrolidones, polyacrylic acids, polymethacrylic acids, polyacrylamides, polyvinyl imidazoles and polyvinyl pyrazoles, and other various synthetic hydrophilic high molecular compounds.

The silver halide emulsions to be used in the present process may be either chemically sensitized or not. As methods for chemical sensitization of silver halide emulsions there are known a sulfur sensitization method, a reduction sensitization method and a noble metal sensitization method. In the present invention these sensitization methods can be used singly or in combination.

A typical example of the noble metal sensitization is a gold sensitization method using a gold compound, particularly a gold complex salt. The agent to be used in this method may also contain a complex salt of noble metals other than gold such as platinum, palladium and rhodium. Specific examples of such complex salts are described in U.S. Pat. No. 2,448,060 and British Pat. No. 618,061.

The agent to be used in the sulfur sensitization method (sulfur sensitizing agent) may contain a sulfur compound contained in gelatin or other various sulfur compounds such as thiosulfates, thioureas, thiazoles and rhodanines.

As the agent for the reduction sensitization method (reduction sensitizer), there may be used stannous salts, amines, formamidinesulfinic acids and silane compounds.

In order to improve sensitivity, the light-sensitive material to be used in the present invention may comprise sensitizing dyes as described in Japanese Patent Application (OPI) No. 52050/80 (pp. 45–53) (e.g., cyanine dyes and merocyanine dyes).

These sensitizing dyes can be used singly or in combination. Such a combination of these dyes is often used for the purpose of supersensitization. The present emulsion may contain a dye which has no effect of spectral sensitization itself or a substance which does not substantially absorb visible light but provides a supersensitizing effect together with such a sensitizing dye.

Useful sensitizing dyes, combinations of dyes providing a supersensitizing effect and substances providing a supersensitizing effect are described in *Research Disclosure*, No. 17643 (Vol. 176, IV-J, page 23, published in Dec., 1978).

The present light-sensitive material can contain various compounds for the purpose of inhibiting fog during preparation, storage or photographic processing of the light-sensitive material or stabilizing the photographic properties thereof. Examples of such compounds include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketone compounds such as oxazolinethione; azaindenes such as triazaindenes, tetraazaindenes (particularly 4-hydroxy-substituted (1,3,3*a*,7)tetraazindenes), and pentaazaindenes; and various compounds known as fog inhibitors or stabilizers such as benzenethiosulfonic acid, benzenesulfinic acid and benzenesulfonic acid amide. Preferred among these compounds are benzotriazoles (e.g., 5-methylbenzotriazole) and nitroindazoles (e.g., 5-nitroindazole). These compounds may be contained in the processing solution.

The present photographic light-sensitive material may contain an inorganic or organic hardener in the photographic emulsion layer or other hydrophilic colloid layer. For example, there may be used singly or in combination chromium salts such as chrome alum and chromium acetate, aldehydes such as formaldehyde, glyoxal and glutaraldehyde, N-methylol compounds such as dimethylolurea and methyloldimethylhydantoin, dioxane derivatives such as 2,3-dihydroxydioxane, active vinyl compounds such as 1,3,5-triacryloyl-hexahydro-s-triazine and 1,3-vinylsulfonyl-2-propanol, active halogen compounds such as 2,4-dichloro-6-hydroxy-s-triazine, and mucohalogenic acids such as mucochloric acid and mucophenoxy chloric acid.

The photographic emulsion layer or other hydrophilic colloid layers in the light-sensitive material prepared in accordance with the present invention may contain various surface active agents for the purpose of facilitating coating, improving antistatic properties, sliding properties, and photographic properties (e.g., acceleration of development, high contrast, and sentization), achieving emulsification dispersion, and inhibiting adhesion.

Examples of such surfaces active agents include nonionic surface active agents such as saponin (steroid series), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides and polyethylene oxide adducts of silicone), glycidol derivatives (e.g., polyglyceride alkenylsuccinate and alkylphenol polyglyceride), aliphatic acid esters of polyvalent alcohols, and alkyl esters of sugar; anionic surface active agents containing acidic groups such as carboxy groups, sulfo groups, phospho groups, sulfuric ester groups, and phosphoric ester groups (e.g., alkyl carboxylate, alkylsulfonate, alkylbenzenesulfonate, alkylnaphthalenesulfonate, alkylsulfuric acid esters, alkylphosphoric acid esters, N-acyl-N-alkyltauric acids, sulfosuccinic acid esters, sulfoalkyl polyoxyethylene alkylphenyl ethers, and polyoxyethylene alkylphosphoric acid esters; amphoteric surface active agents such as amino acids, aminoalkylsulfonic acids, aminoalkylsulfuric or phosphoric acid esters, alkylbetaines, and amine oxides; and cationic surface active agents such as alkyl amine salts, aliphatic or aromatic quaternary ammonium salts, heterocyclic quaternary ammonium salts (e.g., pyridinium and imidazolium), and phosphonium or sulfonium salts containing aliphatic or heterocyclic groups. Furthermore, fluorine surface active agents as described in Japanese Patent Publication No. 44411/81 may be used.

An example of a surface active agent which is particularly preferably used in the present invention is a polyalkylene oxide having a molecular weight of 600 or more as described in Japanese Patent Publication No. 9412/83.

The photographic light-sensitive material of the present invention may contain matting agents such as silica, magnesium oxide, and polymethyl methacrylate in the photographic emulsion layer or other hydrophilic colloid layers for the purpose of inhibiting adhesion or like purposes.

The light-sensitive material to be used in the present invention may contain a dispersion of a water-insoluble or sparingly water-soluble synthetic polymer for the purpose of improving the dimensional stability or like purposes. For example, alkyl (meth)acrylate, alkoxyalkyl (meth)acrylate, glycidyl (meth)acrylate, (meth)acrylamide, a vinyl ester such as vinyl acetate, acrylonitrile, olefin, and styrene can be used singly or in combination. Furthermore, polymers comprising as a monomer component a combination of such compounds with acrylic acid, methacrylic acid, $\alpha,\beta$-unsaturated dicarboxylic acid, hydroxyalkyl (meth)acrylate, sulfoalkyl (meth)acrylate, and styrenesulfonic acid can be used.

The support which can be used in the present invention is not specifically limited. Examples of the support include cellulose triacetate, cellulose diacetate, nitrocellulose, polystyrene, polyethylene terephthalate, etc.

The developing agent which can be used in the present developing solution is not specifically limited. However, it preferably includes dihydroxybenzenes because an excellent dot quality can easily be provided. A combination of a dihydroxybenzene with a 1-phenyl-3-pyrazolidone or p-aminophenol can be used.

Examples of such dihydroxybenzene developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Particularly preferred among these compounds is hydroquinone.

Examples of developing agents comprising 1-phenyl-3-pyrazolidone or its derivatives to be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone and 1-p-tolyl-4,4-dimethyl-3-pyrazolidone.

Examples of p-aminophenol developing agents which can be used include N-methyl-p-aminophenol, p-aminophenol, N-($\beta$-hydroxyethyl)-p-aminophenol, N-(4-hydroxyphenyl)glycine, 2-methyl-p-aminophenol and p-benzylaminophenol. Particularly preferred among these compounds is N-methyl-p-aminophenol.

The present developing agent is preferably used in an amount of 0.05 to 0.8 mol/liter. If a combination of a dihydroxybenzene with a 1-phenyl-3-pyrazolindone or p-aminophenol is used, the amounts of the former and the latter used are 0.05 to 0.5 mol/liter and 0.06 mol/liter or less, respectively.

Examples of sulfite preservatives which can be used in the present invention include sodium sulfite, potassium sulfite, lithium sulfite, ammonium sulfite, sodium bisulfite, potassium metabisulfite and sodium formaldehyde bisulfite. Such a sulfite is used in an amount of 0.15 mol/liter or more, preferably 0.4 mol/liter or more, particularly preferably 0.5 mol/liter or more. The upper limit of the amount of such a sulfite to be used is preferably 2.5 mol/liter.

Examples of alkali agents for adjustment of the pH value of the developing solution include sodium hydroxide, potassium hydroxide, sodium carbonate, potassium carbonate, tribasic sodium phosphate, tribasic potassium phosphate, and other pH adjusting agents and buffering agents. The pH value of the developing solution is in the range of 10.5 to 12.0, preferably in the range of 11.0 to 12.0.

Examples of additives which can be used other than the above-described components include development inhibitors such as boric acid and borax, sodium bromide, potassium bromide, and potassium iodide; organic solvents such as ethylene glycol, diethylene glycol, triethylene glycol, dimethylformamide, methyl cellosolve, hexylene glycol, ethanol and methanol; and fog inhibitors or black pepper inhibitors including mercapto compounds such as 1-phenyl-5-mercaptotetrazole and 2mercaptobenzimidazole-5-sodium sulfonate, indazole compounds such as 5-nitroindazole, and benzotriazole compounds such as 5-methylbenzotriazole. The present developing solution may optionally further contain a color toning agent, surface active agent, anti-foaming agent, hard water softener, hardening agent, or amino compound as described in Japanese Patent Application (OPI) No. 106244/81.

As a suitable fixing agent there can be used a composition which is commonly used. As such a fixing agent there may be used an organic sulfur compound known as having a fixing effect besides thiosulfate and thiocyanate. The present fixing solution may contain a water-soluble aluminum compound such as aluminum sulfate and alum as a hardening agent. Such a water-soluble aluminum compound is generally used in an amount of 0.4 to 2.0 g-Al/liter. Furthermore, a trivalent iron compound can be used as an oxidizing agent in the form of a complex salt with ethylenediaminetetraacetate.

The pH of the present fixing solution is generally in the range of 3.5 to 5.5.

The developing temperature is generally selected from the range of 18° to 50° C., preferably 25° to 43° C.

The present invention will be further illustrated in the following examples but the present invention should not be construed as being limited thereto.

Unless otherwise indicated, all percents, ratios, etc., are by weight.

EXAMPLE 1

An aqueous solution of silver nitrate and an aqueous solution of potassium iodide and potassium bromide were added at the same time to an aqueous solution of gelatin which had been maintained at a temperature of 50° C. in the presence of potassium hexachloroiridumate (III), in an amount of $4\times10^{-7}$ mol per 1 mol of silver and ammonia for 60 minutes. At the same time, the pAg value thereof was maintained at 7.8. As a result, a monodispersed emulsion of cubic grains having an average diameter of 0.25 μm and an average silver iodide content of 1 mol % was prepared. A sodium salt of 5,5'-dichloro-9-ethyl-3,3'-bis (3-sulfopropyl)oxacarbocyanine as a sensitizing dye, 4-hydroxy-6-methyl-1,3,3*a*,7-tetraazaindene as a stabilizer, a dispersion of polyethylacrylate, 1,3-divinylsulfonyl-2-propanol, and the present Compound (II-9) were added to the silver iodobromide emulsion thus prepared in an amount of $3\times10^{-3}$ mol per mol of silver. Furthermore, comparative compounds and the present compounds of the general formula (I) were added to the emulsion as shown in Table 1. The emulsion was then coated on a polyethylene terephthalate film in an amount of 3.4 g/m$^2$ as calculated in terms of amount of silver. These samples were then exposed to light, developed, and measured for photographic properties. The results are shown in Table 1.

TABLE 1

| Sample No. | Compound | Added Amount (mol/mol Ag) | Photographic Properties Sensitivity | γ | Black Pepper | Remarks |
|---|---|---|---|---|---|---|
| 1 | — | — | 100 | 14 | 4 | Comparison |
| 2 | (I-2) | $4.6\times10^{-5}$ | 112 | 17 | 4 | Present Invention |
| 3 | (I-2) | $9.2\times10^{-5}$ | 123 | 19 | 4 | Present Invention |
| 4 | Comparative Compound (1) | $4\times10^{-5}$ | 105 | 17 | 3 | Comparison |
| 5 | Comparative Compound (1) | $8\times10^{-5}$ | 112 | 17 | 2 | Comparison |
| 6 | Comparative Compound (2) | $1.6\times10^{-5}$ | 110 | 17 | 2 | Comparison |
| 7 | Comparative Compound (2) | $3.2\times10^{-5}$ | 126 | 20 | 1 | Comparison |

Comparative Compound (1):

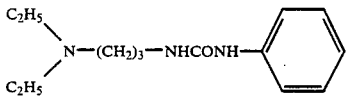

Comparative Compound (2):

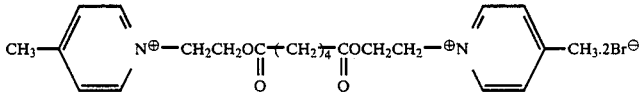

Table 1 shows the relative sensitivity of these samples. The values are shown in terms of the reciprocal of the exposure required to provide a density of 1.5 when the sample is developed by using an FG-660F automatic developing processor (manufactured by Fuji Photo Film Co., Ltd.) at a temperature of 30° C. for 30 seconds. The values shown are values relative to that of Sample No. 1 as 100.

The degree of black pepper is evaluated by five steps. Black pepper "5" is most excellent and black pepper "1" is worst. Black pepper "4" or higher is practicable. Black pepper "3" is poor but is the lowest practicable level. Black pepper "2" or lower is impracticable. The degree between "4" and "3" is evaluated as "3.5". The evaluation of black pepper was the result of development at 38° C. for 40 seconds.

Table 1 shows that the present Sample Nos. 2 and 3 are excellent in sensitivity, gradation γ, and black pepper as compared to the comparative Sample Nos. 1, 4, 5, 6 and 7.

The developing solution used had the following composition:

| | |
|---|---|
| Hydroquinone | 35.0 g |
| N-Methyl-p-aminophenol.½Sulfate | 0.8 g |
| Sodium Hydroxide | 9.0 g |
| Tribasic Potassium Phosphate | 74.0 g |
| Potassium Sulfite | 90.0 g |
| Disodium Ethylenediaminetetraacetate | 1.0 g |
| 3-Diethylamino-1-propanol | 15.0 g |
| 5-Methylbenzotriazole | 0.5 g |
| Sodium Bromide | 3.0 g |
| Water to make | 1 liter |
| pH | 11.60 |

EXAMPLE 2

A sodium salt of 5,5'-dichloro-9-ethyl-3,3'-bis(3-sulfopropyl)oxacarbocyanine as a sensitizing dye, 4-hydroxy-6-methyl-1,3,3*a*,7-tetraazaindene as a stabilizer, a dispersion of polyethylacrylate, an aqueous latex (a) of the structural formula shown below, 1,3-divinylsulfonyl-2-propanol, and the present Compound (II-66) were added to the silver iodobromide emulsion prepared in Example 1 in an amount of $1\times10^{-4}$ mol per mol of Ag. Furthermore, the present compound of the general formula (I) was added to the emulsion as shown in Table 2. The emulsion was then coated on a polyethylene terephthalate film in an amount of 3.2 g/m$^2$ as calculated in terms of amount of silver. These samples were exposed to light, developed, and measured for photographic properties in the same manner as in Example 1. The results are shown in Table 2.

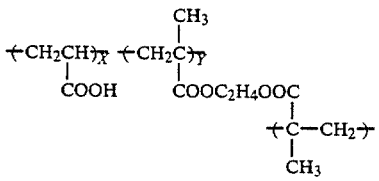

Aqueous Latex (a)

X/Y = 70/30 (molar ratio)

TABLE 2

| Sample No. | Compound | Added Amount (mol/mol Ag) | Photographic Properties Sensitivity | γ | Black Pepper | Remarks |
|---|---|---|---|---|---|---|
| 1 | — | — | 100 | 12.5 | 4 | Comparison |
| 2 | (I-1) | $4.5 \times 10^{-5}$ | 123 | 16 | 4 | Present Invention |
| 3 | (I-1) | $9 \times 10^{-5}$ | 141 | 17 | 4 | Present Invention |
| 4 | (I-2) | $4.6 \times 10^{-5}$ | 120 | 15 | 4 | Present Invention |
| 5 | (I-2) | $9.2 \times 10^{-5}$ | 139 | 17.5 | 4 | Present Invention |

The photographic properties and black pepper were evaluated in the same manner as in Example 1.

Table 2 shows that the present Sample Nos. 2 to 5 provide a high sensitivity and a high gradation γ without causing black pepper as compared to the comparative Sample No. 1.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one light-sensitive silver halide emulsion layer provided on a support and containing at least one hydrazine compound and at least one amine compound of the general formula (I) in said emulsion layer or at least one of other constituting layers, wherein said hydrazine compound and said amine compound can be present in the same or different layers:

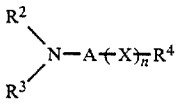

(I)

wherein $R^2$ and $R^3$, which can be the same or different, each represents a substituted or unsubstituted alkyl group or $R^2$ and $R^3$ may be linked to each other to form a ring; $R^4$ represents a substituted or unsubstituted alkyl, aryl or heterocyclic group; A represents a divalent linkage group; X represents $—CONR^5—$, $—OCONR^5—$, $—NR^5CONR^5—$, $—NR^5COO—$, $—COO—$, $—OCO—$, $—CO—$, $—NR^5CO—$, $—SO_2NR^5—$, $—NR^5SO_2—$, $—SO_2—$, —S— or —O— group, in which $R^5$ represents a hydrogen atom or a lower alkyl group having 1 to 5 carbon atoms; and n represents an integer of 0 or 1, with the proviso that the total number of carbon atoms contained in $R^2$, $R^3$, $R^4$ and A is 20 or more.

2. A silver halide photographic material as claimed in claim 1, wherein the amine compound of the general formula (I) is present in an amount of $1 \times 10^{-5}$ to $1 \times 10^{-1}$ mol per mol of total silver halide.

3. A silver halide photographic material as claimed in claim 2, wherein the amine compound of the general formula (I) is present in an amount of $1 \times 10^{-4}$ to $5 \times 10^{-2}$ mol per mol of total silver halide.

4. A silver halide photographic material as claimed in claim 1, wherein the amine compound of the general formula (I) is incorporated in the silver halide emulsion layer.

5. A silver halide photographic material as claimed in claim 4, wherein the amine compound of the general formula (I) is added between the completion of chemical ripening and before coating.

6. A silver halide photographic material as claimed in claim 1, wherein the hydrazine compound is represented by the general formula (II):

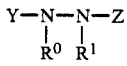

(II)

wherein Y represents an aliphatic, aromatic or heterocyclic group; Z represents a formyl group, an acyl group, an alkyl- or arylsulfonyl group, an alkyl- or arylsulfinyl group, a carbamoyl group, a sulfinamoyl group, an alkoxy- or aryloxycarbonyl group, a sulfinamoyl group, an alkoxysulfonyl group, a thioacyl group, a thiocarbamoyl group, or a heterocyclic group; and $R^0$ and $R^1$ each represents a hydrogen atom or one of $R^0$ and $R^1$ represents a hydrogen atom and the other represents a substituted or unsubstituted alkylsulfonyl group, a substituted or unsubstituted arylsulfonyl group, a substituted or unsubstituted acyl group, with the proviso that Z, $R^1$ and the nitrogen atom to which Z and $R^1$ are bonded may form a partial structure of hydrazine

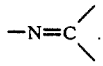

7. A silver halide photographic material as claimed in claim 1, wherein the substituents for $R^4$ are one or more substituents selected from the group consisting of a halogen atom, an alkyl group, an aryl group, an alkoxy group, an aryloxy group, an alkylthio group, an arylthio group, an acyl group, an acyl amino group, a nitro group, a cyano group, an oxycarbonyl group, a hydroxy group, a carboxy group, a sulfo group, a uredo group, a sulfonamide group, a sulfamoyl group, a carbamoyl group, an acyloxy group, an amino group, a carbonic ester group, a sulfone group, and a sulfonyl group.

8. A method for forming a superhigh contrast negative image, which comprises imagewise exposing a silver halide photographic material comprising at least one silver halide emulsion layer provided on a support and containing at least one hydrazine compound and at least one amine compound of the general formula (I) in said emulsion layer or at least one of other constituting layers to light provided said hydrazine compound and said amine compound can be present in the same or different layers, and then developing the silver halide photographic material thus exposed with a developing solution having a pH value of 10.5 to 12.0 and containing 0.15 mol/liter or more of sulfite ions:

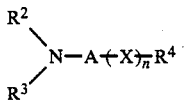

(I)

wherein $R^2$ and $R^3$, which can be the same or different, each represents a substituted or unsubstituted alkyl group or $R^2$ and $R^3$ may be linked to each other to form a ring; $R^4$ represents a substituted or unsubstituted alkyl, aryl or heterocyclic group; A represents a divalent linkage group; X represents —$CONR^5$—, —O-$CONR^5$—, —$NR^5CONR^5$13 , —$NR^5COO$—, —COO—, —OCO—, —CO—, —$NR^5CO$—, —$SO_2N$-$R^5$—, —$NR^5SO_2$—, —$SO_2$—, —S— or —O— group, in which $R^5$ represents a hydrogen atom or a lower alkyl group having 1 to 5 carbon atoms; and n represents an integer of 0 or 1, with the proviso that the total number of carbon atoms contained in $R^2$, $R^3$, $R^4$ and A is 20 or more.

9. A method for forming a superhigh contrast negative image as claimed in claim 8, wherein the amine compound of the general formula (I) is present in an amount of $1\times10^{-5}$ to $1\times10^{-1}$ mol per mol of total silver halide.

10. A method for forming a superhigh contrast negative image as claimed in claim 9, wherein the amine compound of the general formula (I) is present in an amount of $1\times10^{-4}$ to $5\times10^{-2}$ mol per mol of total silver halide.

11. A method for forming a superhigh contrast negative image as claimed in claim 8, wherein the amine compound of the general formula (I) is incorporated in the silver halide emulsion layer.

12. A method for forming a superhigh contrast negative image as claimed in claim 11, wherein the amine compound of the general formula (I) is added between the completion of chemical ripening and before coating.

13. A method for forming a superhigh contrast negative image as claimed in claim 8, wherein the hydrazine compound is represented by the general formula (II):

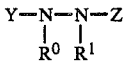

(II)

wherein Y represents an aliphatic, aromatic or heterocyclic group; Z represents a formyl group, an acyl group, an alkyl- or arylsulfonyl group, an alkyl- or arylsulfinyl group, a carbamoyl group, a sulfamoyl group, an alkoxy- or aryloxycarbonyl group, a sulfinamoyl group, an alkoxysulfonyl group, a thioacyl group, a thiocarbamoyl group, or a heterocyclic group; and $R^0$ and $R^1$ each represents a hydrogen atom or one of $R^0$ and $R^1$ represents a hydrogen atom and the other represents a substituted or unsubstituted alkylsulfonyl group, a substituted or unsubstituted arylsulfonyl group, a substituted or unsubstituted acyl group, with the proviso that Z, $R^1$ and the nitrogen atom to which Z and $R^1$ are bonded may form a partial structure of hydrazine

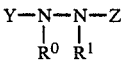

(II)

14. A method for forming a super high contrast negative image as claimed in claim 8, wherein the substituents for $R^4$ are one or more substituents selected from the group consisting of a halogen atom, an alkyl group, an aryl group, an alkoxy group, an aryloxy group, an alkylthio group, an arylthio group, an acyl group, an acyl amino group, a nitro group, a cyano group, an oxycarbonyl group, a hydroxy group, a carboxy group, a sulfo group, a uredo group, a sulfonamide group, a sulfamoyl group, a carbamoyl group, an acyloxy group, an amino group, a carbonic ester group, a sulfone group, and a sulfonyl group.

* * * * *